US011371343B2

(12) United States Patent
Greci et al.

(10) Patent No.: US 11,371,343 B2
(45) Date of Patent: Jun. 28, 2022

(54) ELECTRONIC CONTROLLED FLUIDIC SIREN BASED TELEMETRY

(71) Applicant: Halliburton Energy Services, Inc., Houston, TX (US)

(72) Inventors: Stephen Michael Greci, Little Elm, TX (US); Michael Linley Fripp, Carrollton, TX (US); Richard Decena Ornelaz, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 428 days.

(21) Appl. No.: 16/474,450

(22) PCT Filed: Feb. 8, 2018

(86) PCT No.: PCT/US2018/017360
§ 371 (c)(1),
(2) Date: Jun. 27, 2019

(87) PCT Pub. No.: WO2019/156668
PCT Pub. Date: Aug. 15, 2019

(65) Prior Publication Data

US 2021/0348508 A1 Nov. 11, 2021

(51) Int. Cl.
*E21B 47/18* (2012.01)
*E21B 41/00* (2006.01)
(Continued)

(52) U.S. Cl.
CPC ..... *E21B 47/18* (2013.01); *E21B 41/0085* (2013.01); *E21B 47/10* (2013.01); *E21B 43/08* (2013.01)

(58) Field of Classification Search
CPC ..... E21B 47/18; E21B 41/0085; E21B 47/10; E21B 43/08
See application file for complete search history.

(56) References Cited

U.S. PATENT DOCUMENTS 5,517,464 A * 5/1996 Lerner ..... E21B 47/20 367/84
5,586,083 A 12/1996 Chin et al.
(Continued)

OTHER PUBLICATIONS

US 9,587,488 B2, 03/2017, Yang (withdrawn)
(Continued)

*Primary Examiner* — Brad Harcourt
(74) *Attorney, Agent, or Firm* — McGuireWoods LLP

(57) ABSTRACT

A system for fluidic siren based telemetry is provided. The system includes a non-rotating restrictor and a rotating restrictor positioned relative to the non-rotating restrictor that is configured to control a flow passage to the non-rotating restrictor. The system includes a turbine coupled to the rotating restrictor and configured to rotate in response to fluid flow along a flow path. The system also includes a generator coupled to the turbine and a controller device electrically coupled to the generator. The controller device is configured to provide one or more encoded signals to the generator to adjust a rotational velocity of the rotating restrictor and causing the rotating restrictor to create different acoustic signatures through the flow passage for wireless communication of a telemetry signal to a surface based on the adjusted rotational velocity of the rotating restrictor.

19 Claims, 6 Drawing Sheets

(51) Int. Cl.
*E21B 47/10* (2012.01)
*E21B 43/08* (2006.01)

(56) References Cited

U.S. PATENT DOCUMENTS

| | | | | |
|---|---|---|---|---|
| 5,636,178 | A | 6/1997 | Ritter | |
| 7,082,078 | B2 | 7/2006 | Fripp et al. | |
| 8,902,678 | B2 | 12/2014 | Vick, Jr. et al. | |
| 9,574,441 | B2 | 2/2017 | Liu et al. | |
| 9,624,768 | B2 | 4/2017 | Yang | |
| 2003/0192692 | A1* | 10/2003 | Tubel | E21B 43/26 166/250.15 |
| 2012/0146805 | A1* | 6/2012 | Vick, Jr. | E21B 34/14 340/853.2 |
| 2016/0265315 | A1 | 9/2016 | Frosell et al. | |
| 2017/0009574 | A1 | 1/2017 | Murphree et al. | |
| 2018/0340413 | A1* | 11/2018 | Shah | F01D 21/00 |
| 2018/0340415 | A1* | 11/2018 | Chin | E21B 47/20 |

OTHER PUBLICATIONS

International Search Report & Written Opinion for International Application No. PCT/US2018/017360; dated Sep. 10, 2018. (16 Pages).

* cited by examiner

ELECTRONIC CONTROLLED FLUIDIC SIREN BASED TELEMETRY

TECHNICAL FIELD

The present disclosure relates to downhole telemetry systems, and more particularly to electronic controlled fluidic siren based telemetry.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation. In certain instances, communications may take place between the surface of the well site and downhole elements. These communications may be referred to as downhole telemetry and may be used to transmit data from downhole sensors and equipment to computing systems located at the surface, which may utilize the data to inform further operations in numerous ways.

BRIEF DESCRIPTION OF THE DRAWINGS

The following figures are included to illustrate certain aspects of the implementations, and should not be viewed as exclusive implementations. The subject matter disclosed is capable of considerable modifications, alterations, combinations, and equivalents in form and function, as will occur to those skilled in the art and having the benefit of this disclosure.

DETAILED DESCRIPTION

Figure 1:
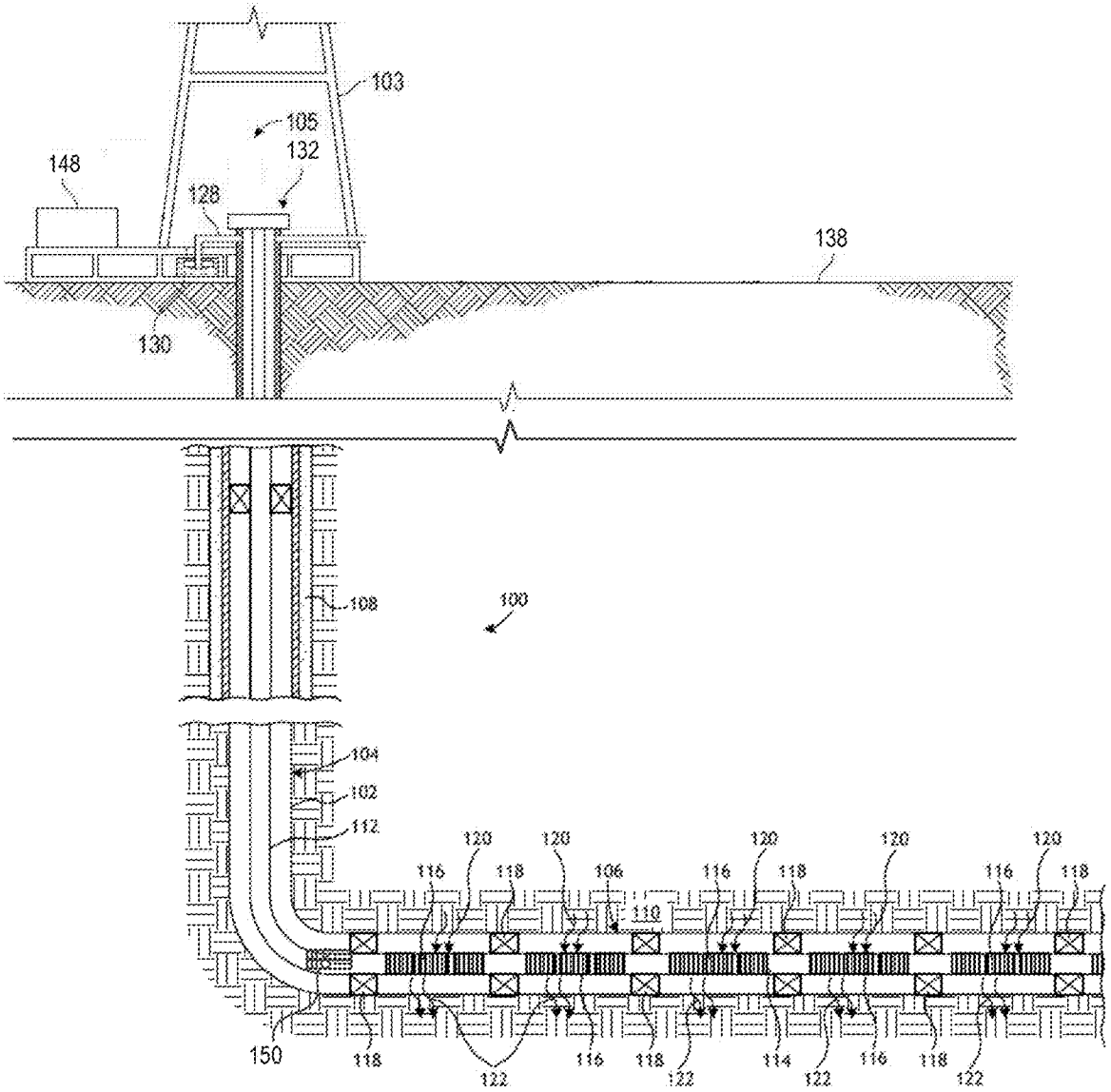
FIG. 1 illustrates an exemplary completion assembly for implementing the processes described herein in accordance with one or more implementations of the subject technology.

The subject disclosure explains how to enable telemetry with low frequency acoustic methods. Fluid flow past a siren device is what spins a turbine and enables pressure pulses to occur as ports are opened/closed by the spinning. The subject technology provides for an electric motor to be mounted to the system to slow down (by altering the rotational velocity of the turbine) of the siren device, in order to create unique acoustic signatures that can be used for wireless communication. In some aspects, an electronic inflow control device (eICD) package may be deployed downhole to sense a fluid breakthrough, or other downhole event, and it is then able to communicate to each consecutive eICD located upstream, such as information on its status, so that the eICDs can all work together more efficiently.

In the current state of the art, obtaining additional data of what is happening downhole is desirable. In traditional downhole completion tools, a conductor is arranged in a tubing encapsulated sensing cable (TESC) and conveyed downhole to sensors positioned in a wellbore to carry measurement signals back to the surface and to provide power to downhole tools positioned in the wellbore. However, the wired connection is inherently expensive and difficult to establish in many wellbore environments (e.g., extended reach laterals, multi-lateral wells). An alternative approach to the wired connection is to obtain data wirelessly. For example, acoustic telemetry has been employed inside or on tubing, which makes acoustic vibrations through the tubing. In other aspects, turbines have been employed downhole for power generation. In the current state of the art, these components have been kept separate—that the method of telemetry and the method of generating power are two different components.

In one or more implementations, a siren device (or referred to herein as a "downhole fluidic siren") is employed to create acoustic pulses in a fluid and use an electric motor to adjust the frequency at which the downhole fluidic siren is making its acoustic noises (or pulses) to create a new way of wireless communication. In some implementations, the downhole fluidic siren includes a turbine that facilitates the rotation of the siren and rotating disk (or referred to herein as a "rotating restrictor"), and also generates power for the electric motor. The power generated is used for powering a controller board that is electrically coupled to the electric motor. The controller board may be operable to adjust a load on the electric motor. For example, restrictions may be applied to the electric motor to adjust the rotational force applied to the turbine. In some aspects, the restrictions applied to the electric motor causes adjustments to the rotational speed of the turbine such that the turbine produces adjustments to the fluidic pulses flowing through the disks in order to encode a telemetry signal for wireless transmission uphole to the surface. The telemetry signal produced by the downhole fluidic siren is a digital signal, where in prior art the telemetry signal was an analog signal. The downhole fluidic siren produces a digitally encoded binary signal (e.g., 0s, 1s) that travels upstream, whereas it was previously created as an analog signal proportional to flow rate.

In some aspects, the electric motor can act as a generator and store energy in the on-board capacitors or rechargeable batteries during normal fluid flow, when no information is needed to be communicated. When the downhole fluidic siren is ready to communicate, the stored power can be used to provide resistance from the motor. In this way, the system is self-powered.

In some implementations, repeaters can be placed all along the tubing string to enable surface to toe communication, or the communication could be limited to just the siren devices within a particular zone or well. For example, in several aspects, eICDs that are able to communicate with each other can help the well produce fluids more effectively.

Communication from surface to downhole is becoming more and more critical for the next generation of smart wells.

FIG. 1 illustrates a well system 100 with a completion assembly for implementing the fluidic siren based telemetry described herein in accordance with one or more implementations. As illustrated, the well system 100 may include a service rig 103 that is positioned on the earth's surface 138 and extends over and around a wellbore 102 that penetrates a subterranean formation 110. The service rig 103 may be a drilling rig, a completion rig, a workover rig, a production rig, or the like. In some embodiments, the service rig 103 may be omitted and replaced with a standard surface wellhead completion or installation, without departing from the scope of the disclosure. Moreover, while the well system 100 is depicted as a land-based operation, it will be appreciated that the principles of the present disclosure could equally be applied in any sea-based or sub-sea application where the service rig 103 may be a floating platform, a semi-submersible platform, or a sub-surface wellhead installation as generally known in the art.

The well system 100 can also include additional or different features that are not shown in FIG. 1. For example, the well system 100 can include additional drilling system components, wireline logging system components, production system components, completion system components, or other components. In the present disclosure, electronic controlled fluidic sirens may be permanently (or non-permanently) installed in a tubing assembly in a well with the objective of monitoring hydrocarbon production rates and fluid breakthrough events over time.

As depicted, the well system 100 includes the wellbore 102 that extends through various earth strata and has a substantially vertical section 104 that extends to a substantially horizontal section 106. The upper portion of the vertical section 104 may have a casing string 108 cemented therein, and the horizontal section 106 may extend through a hydrocarbon bearing subterranean formation 110. In at least one implementation, the horizontal section 106 may be arranged within or otherwise extend through an open hole section of the wellbore 102. In other implementations, however, the horizontal section 106 may also include casing 108 positioned therein, without departing from the scope of the disclosure.

Horizontal drilling techniques for forming a wellbore often include vertically drilling from a surface location to a desired subterranean depth, from which point, drilling is curved or at a sub-terrain plane approximately horizontal to the surface to connect the wellbore to multiple hydrocarbon deposits. The wellbore 102 may be drilled into the subterranean formation 110 using any suitable drilling technique and may extend in a substantially vertical direction away from the earth's surface 138 over a vertical wellbore portion. At some point in the wellbore 102, the vertical wellbore portion may deviate from vertical relative to the earth's surface 108 and transition into a substantially horizontal portion 106. In other embodiments, however, the casing string may be omitted from all or a portion of the wellbore 102 and the principles of the present disclosure may equally apply to an "open-hole" environment.

A tubing string 112 may be positioned within the wellbore 102 and extend from the surface (not shown). The tubing string 112 may be any piping, tubular, or fluid conduit used in the oil and gas industry including, but not limited to, drill pipe, production tubing, casing, coiled tubing, intelligent coiled tubing, hybrid coiled tubing, and any combination thereof. The tubing string 112 provides a conduit for fluids extracted from the subterranean formation 110 to travel to the surface. In other embodiments, the tubing string 112 may provide a conduit for fluids to be conveyed downhole and injected into the subterranean formation 110, such as in an injection operation.

At its lower end, the tubing string 112 may be coupled to a completion string 114 arranged within the horizontal section 106. In other implementations, the tubing and completion strings 112, 114 may be considered the same tubing. The completion string 114 divides the completion interval into various production intervals adjacent the subterranean formation 110. As used herein, the term "completion interval" refers to the area within the wellbore 102 where the completion string 114 is located and otherwise where various wellbore operations are to be undertaken using the well system 100, such as production or injection operations.

As depicted, the completion string 114 may include a plurality of screen assemblies 116 axially offset from each other along portions of the completion string 114. Each screen assembly 116 may be positioned between a pair of packers 118 that provides a fluid seal between the completion string 114 and the wellbore 102, thereby defining corresponding production intervals. In operation, the screen assemblies 116 serve the primary function of filtering particulate matter out of the production fluid stream such that particulates and other fines are not produced to the surface.

It should be noted that even though FIG. 1 depicts the screen assemblies 116 as being arranged in an open hole portion of the wellbore 102, embodiments are contemplated herein where one or more of the screen assemblies 116 is arranged within cased portions of the wellbore 102. Also, even though FIG. 1 depicts a single screen assembly 116 arranged in each production interval, any number of screen assemblies 116 may be deployed within a particular production interval without departing from the scope of the disclosure. In addition, even though FIG. 1 depicts multiple production intervals separated by the packers 118, the completion interval may include any number of production intervals with a corresponding number of packers 118 used therein. In other embodiments, the packers 118 may be entirely omitted from the completion interval, without departing from the scope of the disclosure.

While FIG. 1 depicts the screen assemblies 116 as being arranged in a generally horizontal section 106 of the wellbore 102, those skilled in the art will readily recognize that the screen assemblies 116 are equally well suited for use in wells having other directional configurations including vertical wells, deviated wellbores, slanted wells, multilateral wells, combinations thereof, and the like. The use of directional terms such as above, below, upper, lower, upward, downward, left, right, uphole, downhole and the like are used in relation to the illustrative embodiments as they are depicted in the figures, the upward or uphole direction being toward the surface of the well and the downward or downhole direction being toward the toe or bottom of the well.

The well system 100 may be used to undertake various wellbore operations. In some embodiments, for example, the well system 100 may be used to extract fluids 120 from the subterranean formation 110 and transport those fluids 120 to the surface via the tubing string 112. The fluids 120 may be a fluid composition originating from the surrounding formation 110 and may include one or more fluid components, such as oil, water, gas, oil and water, oil and gas, gas and water, gas and oil, carbon dioxide, and the like. As illustrated, each screen assembly 116 may include one or more well screens (not labeled) arranged about the completion string 114 and may further include one or more flow control devices (not shown) used to regulate or restrict the flow of fluids 120 into the completion string 114, and thereby balance flow among the production zones and prevent water or gas coning.

In some implementations, the well system 100 may be used to inject fluids 122 into the surrounding subterranean formation 110, such as in hydraulic fracturing operations, steam-assisted gravity drainage (SAGD) operations, wellbore treatment operations, gravel packing operations, acidizing operations, any combination thereof, and the like. Accordingly, the injected fluids 122 may be water, steam, gas, aqueous or liquid chemicals, acids, or any combination thereof.

In either production or injection operations, the well system 100 may require the use of various downhole tools, components, or devices including, but not limited to, downhole sensors, telemetry devices, chokes, and valves. The downhole sensors may be positioned along the completion interval and used to measure various wellbore properties, such as pressure, temperature, fluid flow properties, and other properties of the formation and the flowing fluid. For example, telemetry devices 150 such as electronic controlled fluidic sirens may be positioned at spaced intervals in the completion string 114 to detect a fluid breakthrough event and report back to the surface that a fluid breakthrough event was detected and at which zone in the well was the fluid breakthrough event detected or to report other sensed properties of the fluid flow. Exemplary telemetry devices 150 include, but are not limited to, pressure pulse telemetry devices for generation of siren-based telemetry. In one or more implementations, the telemetry devices 150 include flow restrictors (e.g., rotating restrictor, non-rotating restrictor) to control the rate of fluid flow along a flow path through the telemetry device such that unique acoustic signatures are generated to form the siren-based telemetry.

The telemetry devices 150 may be communicably coupled to the downhole sensors and otherwise able to communicate the detected wellbore parameters to a surface location. The chokes and valves may include actuatable flow regulation devices, such as variable chokes and valves, and may be used to regulate the flow of the fluids 120, 122 into and/or out of the completion string 114. In some cases, the telemetry devices 150 may be communicably coupled to the chokes and valves and otherwise configured to receive signals from a surface location and thereby operate the chokes and valves based on these signals.

According to the present disclosure, electrical power may be generated downhole using an axial flow turbine assembly, and the generated electrical power may be consumed by "loads" associated with the well system 100, such as the downhole sensors, the telemetry devices 150, and electric motor. In one or more implementations, the axial flow turbine assembly is, or at least part of, the telemetry device 150 and is operable as a fluidic siren to provide acoustic telemetry signals in the fluids 120. As described in more detail below, the axial flow turbine assembly may be configured to receive a fluid flow flowing through a flow path, and an electric motor that is mechanically coupled to the axial flow turbine assembly can apply a resistance in order to adjust the rotational velocity of a rotating disk in the axial flow turbine assembly and thereby produce a digitally-encoded telemetry signal for transmission to the surface. The mechanical coupling between the electric motor and the flow turbine may be a contacting coupling such as with a shaft in some implementations or the mechanical coupling can be a non-contacting coupling such as with a magnetic torque coupler in other implementations. The flow path and/or the fluid flow may result from production or injection operations undertaken within the well system 100.

It will be appreciated by those skilled in the art that even though FIG. 1 depicts a telemetry device (e.g., 150) as being arranged and operating in the horizontal portion of the wellbore 102, the embodiments described herein are equally applicable for use in portions of the wellbore 102 that are vertical, deviated, or otherwise slanted. Moreover, use of directional terms such as above, below, upper, lower, upward, downward, uphole, downhole, and the like are used in relation to the illustrative embodiments as they are depicted in the figures, the upward or uphole direction being toward the top of the corresponding figure and the downward direction being toward the bottom of the corresponding figure, the uphole direction being toward the surface of the well and the downhole direction being toward the toe of the well.

In some implementations, operations of the well head 132 is monitored by surface equipment 105 and a computing subsystem 148 at the surface 138. The surface equipment 105 shown in FIG. 1 operates at or above the surface 138, for example, near the well head 132, to control the telemetry device 150 and possibly other downhole equipment or other components of the well system 100. The computing subsystem 148 receives and analyzes telemetry data from the telemetry device 150. The well system 100 can include additional or different features, and the features of an logging system can be arranged and operated as represented in FIG. 1 or in another manner.

The telemetry signal data is communicated to the computing subsystem 148 for storage, processing, and analysis. Such data may be gathered and analyzed during completion operations, other conveyance operations, or during other types of activities. The computing subsystem 148 receives and analyzes the telemetry signal received from the fluidic sirens to detect the presence of any fluid breakthroughs in the subterranean region 110. For example, the computing subsystem 148 can identify the subterranean zone, type of fluid, and/or other properties of the detected fluid breakthrough based on the telemetry signal wirelessly transmitted by the fluidic siren through the fluid 120 in the wellbore 102.

In some implementations, the well system 100 employs a coiled tubing system. Coiled tubing systems are well known in the oil and gas industry. The term normally connotes a relatively small diameter continuous tubing string that can be transported to a well site on a drum or in a reel. Some methods for inserting coiled tubing systems into existing wells are well known in the art. As oil and gas exploration technology continues to improve the demand for better wellbore information grows and there has been more interest in using coiled tubing to deploy more instrumentation into the wellbore, particularly pressure and temperature sensors.

In some aspects, fluid may be circulated into the well head 132 through the tool string (e.g., 114) and back toward the surface 138 through an annulus between the outer wall of the tool string and the wall of the wellbore 102 to continue completion efforts. To that end, a diverter or outlet conduit 128 may be connected to a container 130 at the wellhead 132 to provide a fluid return flow path from the wellbore 102.

Figure 2:
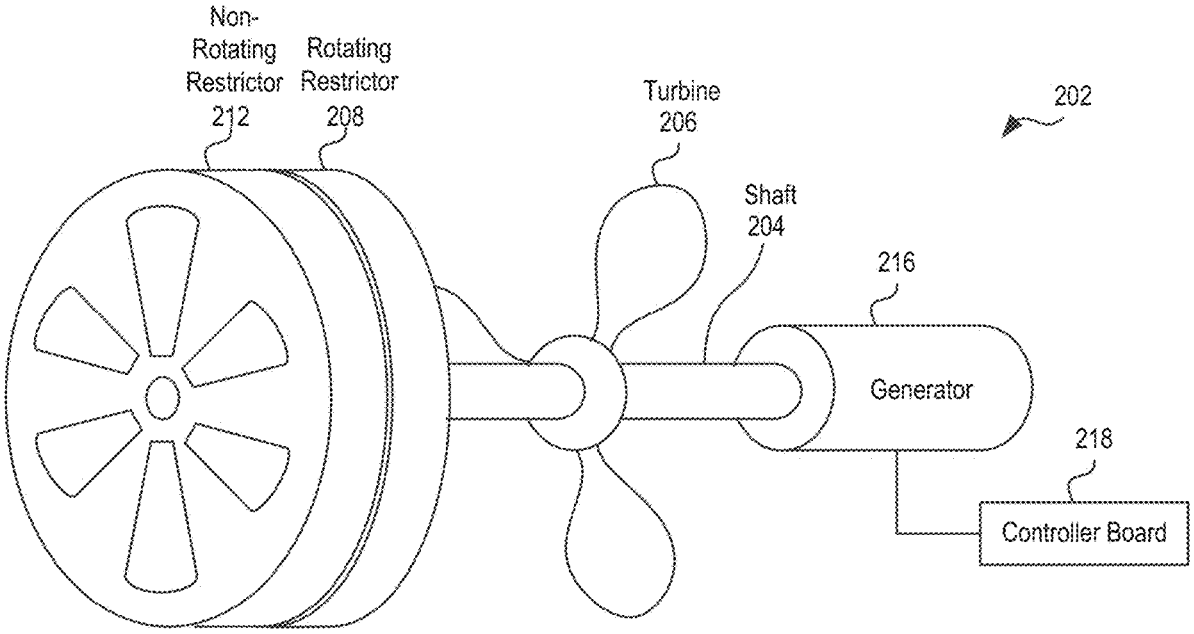
FIG. 2 illustrates an example of an electronic controlled fluidic siren based telemetry system in accordance with one or more implementations of the subject technology.

FIG. 2 illustrates an example of a downhole fluidic siren 202 using axial rotation in accordance with one or more implementations of the subject technology. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

As depicted in FIG. 2, the downhole fluidic siren 202 includes a shaft 204 mechanically coupled to a blade (or turbine) 206 and a rotating restrictor 208. The downhole siren 202 may be a "whistle-type" device. The downhole siren 202 also includes a non-rotating restrictor 212. The shaft 204 is mechanically coupled or magnetically coupled (such as with a magnetic torque coupler) to an electric motor 216. The rotating restrictor 208 is coupled to one end of the shaft 204 and the electric motor 216 is coupled to the opposite end of the shaft 204. The electric motor is electrically coupled to a controller board 218. For example, the electrical coupling may include an inductive coupling connection in some implementations, or a capacitive coupling connection in other implementations.

In operation, the rotating restrictor 208 rotates relative to the non-rotating restrictor 212 to facilitate the opening and closing of the flow passage through the two restrictors that creates the telemetry signal. The rotating torque created by the turbine 206 is acting on the electric motor 216. The rotating torque is created by the flow path of the turbine 206, in which the electric motor 216 does not create the rotational torque (or contribute to making the turbine 206 spin). Rather, the electric motor 216 provides resistance to the turbine 206 to slow down the rotational velocity of the turbine 206.

In one or more implementations, a downhole sensor (not shown) is electronically coupled to the controller board 218 to detect one or more events for controlling the electric motor 216. The controller board 218 reads a value from the sensor, and translates (or maps) the sensor value into a digital command value. In some aspects, the controller board 218 obtains an analog signal from the sensor and processes the analog signal using an analog-to-digital converter along the signal path from the sensor. The controller board 218 then encodes the digital command value into a binary pattern (e.g., 1's and 0's) to cause the electric motor 216 to vary the flow passage rates through the downhole fluidic siren 202 and thereby produce an acoustic telemetry signal that is wirelessly sent up to the surface. In some aspects, the controller board 218 includes an encoder along the signal path from the analog-to-digital converter in order to generate the binary-patterned electrical signal to the electric motor 216. For example, the encoder can adjust the resistance with the electric motor 216 by proportioning the 1's and 0's pattern of the encoded signal generated by the encoder to the electric motor 216. The controller board 218 can run on a pre-programmed time scale and provide the encoded signal to the electric motor 216 in some implementations, or the controller board 218 can listen for a query from the surface and respond to that query in other implementations.

There are a variety ways known in the art to encode a signal, e.g., frequency-shift keying, amplitude modulation, phase modulation, etc. For example, the sequence of encoding the wireless telemetry signal may operate similar to frequency-shift keying, where pulse positioning is applied to represent the wireless telemetry signal. The pulse positioning can represent a sequence of restrictions applied by the electric motor 216, where a first restriction (e.g., resistance to the rotating line) is applied to the shaft 204 for a first predetermined duration (e.g., 10 seconds) if the encoded signal at a first time is a logical '1', and not provide a resistance for a second predetermined duration (e.g., 10 seconds) if the encoded signal at a second time is a logical '0'. If a restriction is applied by the electric motor 216, then the rotating disk slows down and generates a lower frequency signal in the fluid. If a restriction is not applied by the electric motor 216, then the turbine 206 and the rotating restrictor 208 can rotate faster compared to the rotational speed when a restriction is applied and generate a higher frequency signal in the fluid.

When the electric motor 216 is not running against any back pressure, the rotating restrictor 208 is rotating at a first frequency, and provides an output that is a multiple of the first frequency. As depicted in FIG. 2, the non-rotating restrictor 212 has six openings, and thus the output may be a multiple of six of the rotating frequency. The number of openings on the non-rotating restrictor 212 and rotating restrictor 208 may vary from the number depicted in FIG. 2, and may be an arbitrary number without departing from the scope of the disclosure. When the electric motor 216 provides a resistance onto the rotating restrictor 208, the rotation of the rotating restrictor 208 slows down such that the output that is a multiple of a second frequency.

In some implementations, the electric motor 216 can be positioned in a pipe, such as the completion string 114. The non-rotating restrictor 212 can be permanently positioned in the inner diameter (ID) of the pipe, and the rotating restrictor 208 may be arranged adjacent to the non-rotating restrictor 212 with clearance within the pipe to rotate at a given rate. In other implementations, the non-rotating restrictor 212 and the rotating restrictor 208 are mounted on the outside of the pipe such as in a housing so that flow through the screen assembly (e.g., 116) will flow past the downhole fluidic siren 202 and then enter the ID of the pipe. In this respect, the pipe may have a full bore ID otherwise close to full bore. The fluid flow traverses through the turbine 206. In some aspects, the entire system may be positioned inside the tubing string (e.g., 112). In some implementations, the electric motor 216 is positioned with a dynamic seal to the shaft 204, and the electric board 218 can be in an air-filled chamber such that it is not exposed to the wellbore fluid (e.g., isolated from the fluids 120). The electric motor 216 and the controller board 218 can be in a same air-filled chamber in some implementations, or can be positioned in separate chambers with an electrical connection between the chambers that is completely isolated from the wellbore fluid in other implementations. In some aspects, there can be magnetic coupling between the electric motor 216 and the turbine 206 in order to completely seal the electric motor 216 from the surrounding environment. For example, the electric motor 216 is coupled to the turbine 206 by electromagnetic connection.

As will be appreciated by those skilled in the art, there are several types of electric motors (e.g., 216) and/or generators that may be suitable for the implementations described herein. In some implementations, for example, the electric motor 216 may include a permanent magnet alternating current (AC) generator that uses pairs of magnets (not shown) with alternating poles that rotate relative to coil windings (not shown) to generate an AC signal for converting AC electrical energy into mechanical energy. There are multiple generator topologies that can be used depending on the packaging limitations of the application, and different topologies may vary the configuration of a stator (not shown), the coil windings, and the permanent magnets depending on the available space and manufacturing limitations. Exemplary topologies include, but are not limited to, transverse flux, radial flux, and axial flux configurations.

In other implementations, the electric motor 216 may include a direct current (DC) generator for converting DC electrical energy into mechanical energy. In such implementations, the electric motor 216 may use mechanical commutation to generate DC power. The magnetic field can be generated using permanent magnets or field coils, which may be self-excited or externally excited. In this respect, the encoded signal from the controller board 218 may control the amount of resistance applied by the electric motor 216 by changing the strength of current in either the permanent magnets or field coils depending on implementation. In yet other implementations, the electric motor 216 may include an alternator, which may be similar to the permanent magnet AC generator, but requires an excitation voltage for the coil windings in the place of the permanent magnets.

Figure 3C:
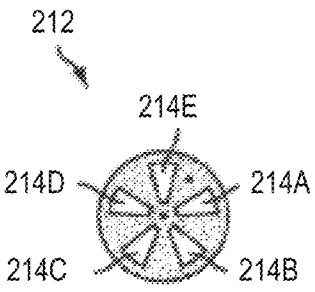
FIGS. 3A-3C illustrate examples of an electronic controlled fluidic siren based telemetry system using axial rotation in accordance with one or more implementations of the subject technology.
Figure 3B:
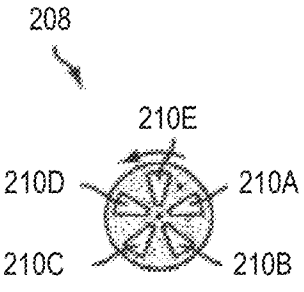
Figure 3A:
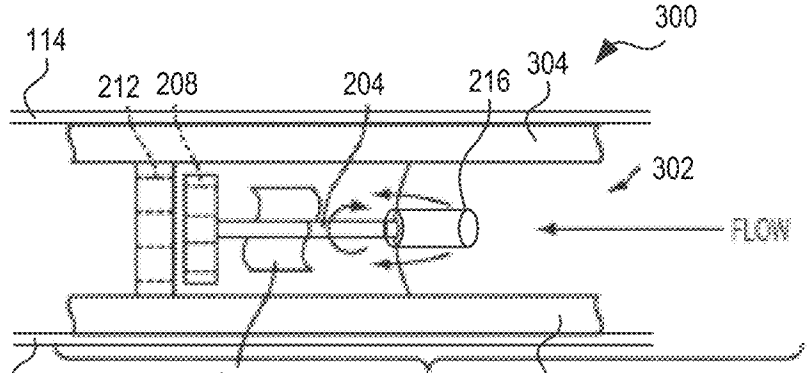

FIGS. 3A-3C illustrate examples of an electronic controlled fluidic siren 300 based telemetry system using axial rotation in accordance with one or more implementations of the subject technology. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

As depicted in FIG. 3A, the downhole fluidic siren 202 includes the shaft 204 mechanically coupled to the turbine 206 and the rotating restrictor 208. An example of the rotating restrictor 208 is depicted in FIG. 3B. The rotating restrictor 208 includes openings 210A-E through which fluid can flow. The downhole siren 202 also includes the non-rotating restrictor 212 positioned adjacent to the rotating restrictor 208, where the rotating restrictor 208 is interposed between the non-rotating restrictor 212 and the turbine 206. An example of the non-rotating restrictor 212 is depicted in FIG. 3C. The non-rotating restrictor 212 includes openings 214A-E generally having the same or similar shape and size as the openings 210A-E of the rotating restrictor 208.

The downhole fluidic siren 202 can receive fluid flow by the turbine 206 along a fluid path 302, which causes the shaft 204 to rotate the rotating restrictor 208. In a low friction downhole siren 202, the rotation rate of the rotating restrictor 208 can be proportional to the velocity of fluid flow. Through rotation of the rotating restrictor 208, openings 210A-E alternate between aligning with openings 214A-E to allow fluid flow and aligning with solid surfaces of the non-rotating restrictor 212 to block fluid flow. Alternating between allowing fluid flow and blocking fluid flow can cause acoustical signals to be outputted having a frequency that is proportional to the rate of rotation, where the rate of rotation may be controlled and adjusted by the electric motor 216 based on an encoded signal from the controller board 218. A receiving device located upstream (or at the surface) can receive the acoustic signals and determine a downhole parameter based on changes in frequency over a predetermined duration of time.

As illustrated, a production tubing 304 may be arranged within the wellbore 102. In some embodiments, the production tubing 304 may be coupled to the distal end of the tubing string 112 of FIG. 1 and stung or otherwise inserted into the interior of a base pipe (e.g., the completion string 114 of FIG. 1). The downhole fluidic siren 202 may be positioned within the interior of the production tubing 304 along the flow path 302 and otherwise configured to receive a flow of the fluids 120 from the formation 110.

The production tubing 304 may define one or more production ports (not shown) that facilitate fluid communication between the subterranean formation 110 and an interior of the production tubing 304, and thereby placing the subterranean formation 110 in fluid communication with the interior of the production tubing 304. Production seals (not shown) may be disposed between the production tubing 304 and a housing, thereby defining a production interval therebetween. As a result, the housing may be radially offset a short distance from the production tubing 304 to define the flow path 302 for the fluids 120 to communicate with the interior of the production tubing 304. The flow path 302 may extend from the subterranean formation 110, through the screen assemblies 116, through the flow ports and into the interior of the housing, through the production ports, and into the interior of the production tubing 304. In other implementations, the flow path 302 may include any portion or section of the aforementioned fluid pathway.

In exemplary operation, the fluids 120 may intrude into the flow path 302 from the surrounding subterranean formation 110 and conveyed into the production tubing 304 after passing through one or more screen assemblies 116. The production seals may prevent the fluids 120 from migrating in either axial direction along the exterior of the production tubing 304. In one or more implementations, as the fluid 120 impinges upon the turbine 206, the turbine 206 is urged to rotate about a rotational axis that is perpendicular to the flow of the fluid 120 (or fluid path 302), and thereby generates electricity in the electric motor 216 when the electric motor 216 is not prompted to adjust the rotational velocity of the turbine 206 for conveying a sequence of telemetry signals to the surface. In one or more implementations, when the electric motor 216 is prompted to adjust the rotational velocity of the turbine 206, the electric motor 216 consumes part of the generated electricity to provide resistance to the turbine 206 along the rotational axis for transmitting a first telemetry signal at a first frequency and decreases the resistance to the turbine 206 for transmitting a second telemetry signal at a second frequency. After passing out of the downhole fluidic siren 202, the fluid 120 may continue within the flow path 302 until entering the interior of the production tubing 304 via the production ports.

As will be appreciated, while FIG. 3A depicts the fluid 120 flowing within the flow path 302 from the subterranean formation 110 to the interior of the production tubing 304 to facilitate generation of telemetry signals and generate electricity using the downhole fluidic siren 202, fluids may alternatively flow in the opposite direction in the flow path 302 and equally generate electricity. More particularly, in an injection operation, fluids (e.g., the fluids 120 of FIG. 1) may be conveyed within the interior of the production tubing 304 and into the flow path 302 from the production ports. From the production ports, the fluid 120 may traverse the downhole fluidic siren 202 and subsequently flow through the flow ports and the screen assemblies 116 to be injected into the surrounding subterranean formation 110. As the fluids pass through the downhole fluidic siren 202, electricity may be generated at the electric motor 216.

As previously described in FIG. 1, there may be a series of electronic controlled fluidic sirens positioned in the well, where respective sensors of the fluidic sirens may detect an intrusion of fluid in a corresponding zone in the well. For example, if water is intruding a region in a well identified as zone 1, the sensor in that zone provides measurements to the controller board that indicate a water intrusion in zone 1. The controller board would then send the encoded signal to the motor to cause the motor to apply an amount of resistance in a series of 1's and 0's that causes the turbine to slow down during applicable time frames. The added resistance causes the fluidic siren to communicate to the surface a telemetry signal indicating that zone 1 has an intrusion of water using a series of 1's and 0's. For example, a first sequence represented as '11001' can identify the location as zone 1, followed by a second sequence represented as '11110' to indicate that water is present in zone 1 or other event. In some implementations, a first portion of the encoded signal can indicate which zone or location in the well, and a second portion of the encoded signal can indicate the event such as what is happening in the well (e.g., intrusion of water, sand, etc., into the well). In some aspects, the telemetry signal is transmitted in the form of a communication packet. In some implementations, the communication packet includes a location address and a command. Other information may be included in the communication packet including a header, error correction, and a checksum.

At the surface, the telemetry signal can be processed to detect changes in frequency. For example, the change may be detected by determining whether the current telemetry signal value changes by a certain percentage over the previous telemetry signal value or by a certain number of frequency units (e.g., Hertz). The changes can be monitored on a fixed time scale, by a length of time between the changes, or by another parameter that examines the changes. The changes help identify a certain delta that represents the logical value (e.g., 1 or 0). In some implementations, a threshold may be employed to identify the true logical value (not a false logical value), in which the threshold helps identify either at least a 10 Hz change on a bit cell change to an expected logical value, or no more than a 1 Hz change in the signal to maintain the existing logical value. For example, a bit value length is about 10 seconds, so during the duration of the 10 seconds, there is an expectation for the signal to have less than a 1 Hz change during that duration to maintain the logical value, or have at least a 10 Hz change during that duration to denote a transition from a first logical value to a second logical value.

In some aspects, the fluidic pulses have a pressure of about 30 psi and a flow rate of about 10 gallons per minute, however, the pressure and flow rate values may vary and be operable at arbitrary values without departing from the scope of the disclosure. In some implementations, the frequency of the telemetry signal is about 30 Hz, however the frequencies at which the telemetry signal is operable can be arbitrary without departing from the scope of the disclosure. By changing the resistance applied by the motor, the frequency at which the telemetry signal is generated changes, not the amplitude of the telemetry signal. The amplitude of the telemetry signal is dominated by the flow rate.

The flow is constantly traversing through turbine, and the fluidic siren is constantly generating an outgoing telemetry signal at a frequency. Well operators at the surface are constantly listening to the uphole telemetry signals, so any changes in the frequency causes the well operators to focus their attention to the telemetry signal. At the zone (e.g., zone 1) where the water cuts through (or intrudes), there may be a series of fluidic sirens located upstream to the surface (e.g., every 100 ft. or 300 ft.) however far they can be spaced apart such that each fluidic siren located upstream can operate as a repeater (where one fluidic siren provides an outgoing telemetry signal to tell the next fluidic siren located upstream, and that fluidic siren provides another outgoing telemetry signal to tell the next fluidic siren located upstream such that the telemetry signal is repeated across the fluidic sirens up to the surface.

In a production environment, there may be a screen located between the fluidic siren and the subterranean formation producing fluid. The fluid being produced from the subterranean formation would flow through the screen, flow through the fluidic siren, and then into the tubing. There may be multiple screens positioned alongside a respective fluidic siren in a well, from the heel to the toe at every 30 ft. (or 100 ft.) depending on implementation. In this respect, the screens may act as multi-stage filters of the fluid flow.

Figure 4:
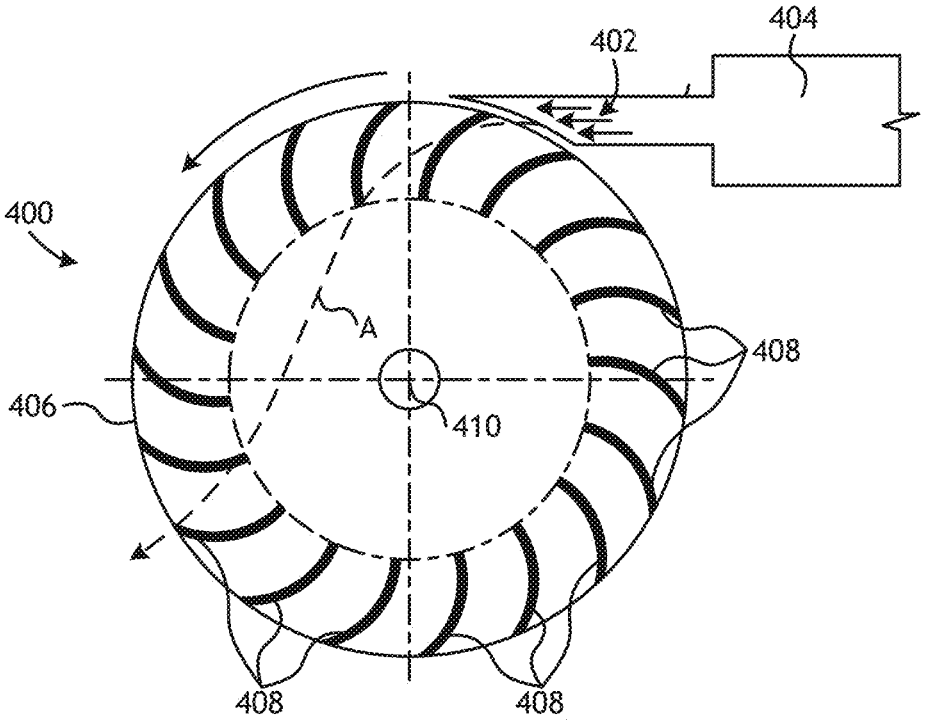
FIG. 4 illustrates an example of an electronic controlled fluidic siren based telemetry system using transverse rotation in accordance with one or more implementations of the subject technology.

In other implementations, the subject system includes a transverse flow siren/generator that provides a different geometry of configuration. FIG. 4 illustrates an example of an electronic controlled fluidic siren based telemetry system using transverse rotation in accordance with one or more implementations of the subject technology.

FIG. 4 depicts a schematic diagram of an exemplary transverse flow fluidic siren 400 that may be used in accordance with the principles of the present disclosure. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

The transverse flow fluidic siren 400 includes a transverse turbine 406 The transverse flow fluidic siren 400 may be configured to receive a flow of a fluid 402 (e.g., the fluid 120 of FIG. 1) from a flow path 404 and provide resistance to the transverse turbine 406 using an electric motor (e.g., 216) to generate a telemetry signal when communication of the telemetry signal to the surface is needed, or convert the kinetic energy and potential energy of the fluid 402 into rotational energy that generates electrical power when no communication of the telemetry signal is needed. The fluid 402 may be any of the fluids 120, 122 described above with reference to FIG. 1. Moreover, as used herein, the term "flow path" refers to a route through which the fluid 402 is capable of being transported between at least two points. In some cases, the flow path 404 need not be continuous or otherwise contiguous between the two points. Exemplary flow paths 404 include, but are not limited to, a flow line, a conduit, a pipeline, production tubing, drill string, work string, casing, a wellbore, an annulus defined between a wellbore and any tubular arranged within the wellbore, an annulus defined between a screen assembly (e.g., 116) and a base pipe, any combination thereof, and the like. In FIG. 4, the flow path 404 may be any fluid route that delivers the fluid 402 to the transverse flow fluidic siren 400 for fluidic siren based telemetry.

The transverse turbine 406 includes a plurality of blades 408 disposed thereabout and configured to receive the fluid 402. As the fluid 402 impinges upon the blades 408, the transverse turbine 406 is urged to rotate about a rotational axis 410. The fluid 402 in the transverse flow fluidic siren 400 is perpendicular to the rotational axis 410 of the transverse turbine 406.

The transverse turbine 406 may receive the fluid 402 transversely (i.e., across) the blades 408, and the fluid 402 may flow through the transverse turbine 406, as indicated by the dashed arrow "A". As the fluid 402 flows through the transverse turbine 406, the blades 408 are urged to rotate the transverse turbine 406 about the rotational axis 410 and thereby generate electricity in an associated power generator (not shown).

The electric motor (not shown) of the transverse flow fluidic siren 400 may be generally positioned within the transverse turbine 406, which reduces the axial height of the transverse flow fluidic siren 400. The transverse turbine 406 may be coupled to a rotor (not shown) to rotate about the rotational axis 410, and one or more magnets may be disposed or otherwise positioned on the transverse turbine 406 for rotation therewith. The transverse flow fluidic siren 400 may include a stator (not shown) that extends at least partially into a hub (not shown) defined by the transverse turbine 406 and magnetic pickups or coil windings (not shown) may be positioned within the hub to interact with the magnets.

The current generated by the rotational motion of the rotor and the interaction of the magnets and the coil windings may be conveyed to a battery and/or capacitors that are external to the electric motor (e.g., 216) or on-board of a controller board (e.g., 218) for storage. The controller board is electrically coupled to the electric motor for controlling the amount of resistance provided by the electric motor using one or more encoded signals. Alternatively, the current may be provided directly to one or more loads, such as a downhole sensor, the controller board, the transverse turbine 406, a choke and/or a valve associated with the well system 100 of FIG. 1.

The electric motor of the transverse flow fluidic siren 400 may be placed in the fluid 402 with a dynamic seal and may otherwise be isolated from the fluid 402. The coil windings and electrical leads of the electric motor may be encapsulated or sealed with a magnetically-permeable material to protect the coil windings and the leads from potential fluid contamination or corrosion.

Figure 5:
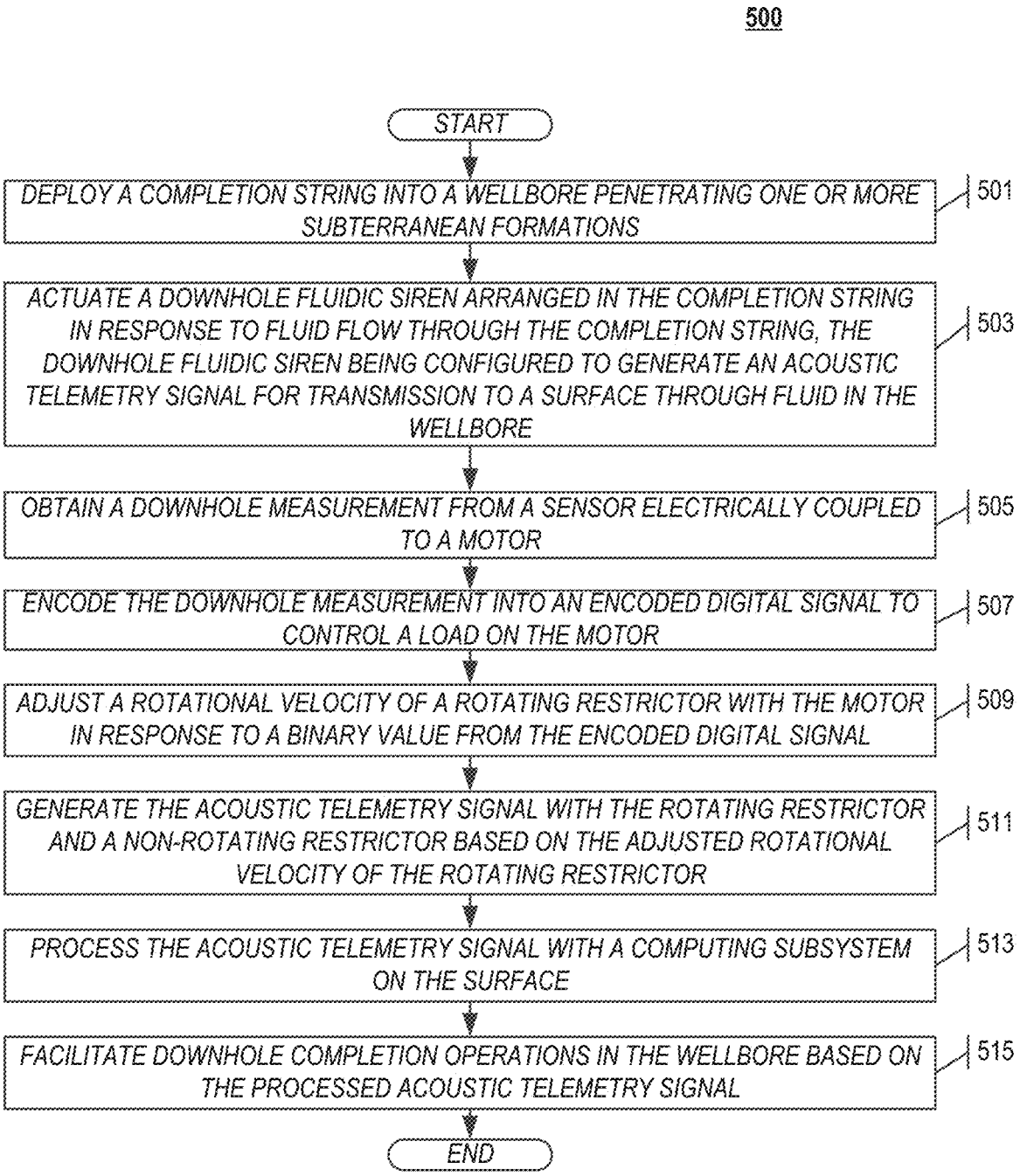
FIG. 5 illustrates an example of a process for employing the electronic controlled fluidic siren based telemetry system in accordance with one or more implementations of the subject technology.

FIG. 5 illustrates an example of a process 500 for employing the electronic controlled fluidic siren based telemetry system in accordance with one or more implementations of the subject technology. Further for explanatory purposes, the blocks of the sequential process 500 are described herein as occurring in serial, or linearly. However, multiple blocks of the process 500 may occur in parallel. In addition, the blocks of the process 500 need not be performed in the order shown and/or one or more of the blocks of the process 500 need not be performed.

The process 500 starts at step 501, where a completion string is deployed into a wellbore penetrating one or more subterranean formations. In some aspects, the completion string is coupled to a computing subsystem positioned on a surface.

Next, at step 503, a downhole fluidic siren arranged in the completion string is actuated in response to fluid flow through the completion string. In some aspects, the downhole fluidic siren is configured to generate an acoustic telemetry signal for transmission to the surface through fluid in the wellbore. The downhole fluidic siren includes a turbine interposed between a rotating restrictor and a motor that provides resistance to the rotating restrictor for creating different acoustic signatures through a flow passage between the rotating restrictor and a non-rotating restrictor.

Subsequently, at step 505, a downhole measurement is obtained from a sensor electrically coupled to the motor. Next, at step 507, the downhole measurement is then encoded into an encoded digital signal to control a load on the motor. In encoding the downhole measurement, the process 500 may include a step for reading a value from the downhole measurement obtained by the sensor with a controller device electrically coupled to the motor. Next, the process 500 may include a step for converting the value from an analog domain to a digital domain to produce a digital command value using an analog-to-digital converter along a signal path from the sensor. Subsequently, the process 500 may include a step for mapping the digital command value into a binary pattern using an encoder arranged along the signal path from the analog-to-digital converter to generate a binary-patterned electrical signal in the encoded digital signal.

At step 509, a rotational velocity of the rotating restrictor is adjusted with the motor in response to a binary value from the encoded digital signal. In adjusting the rotational velocity of the rotating restrictor, the process 500 may include a step for proportioning the binary pattern to different amounts of resistance applied by the motor such that each amount of resistance applied corresponds to a different rotational velocity produced by the rotating restrictor. In adjusting the rotational velocity of the rotating restrictor, the process 500 may also include a step for adjusting the load on the motor to produce the resistance against a rotation of the rotating restrictor, and next, the process 500 may include a step for applying the resistance to the rotating restrictor through a shaft mechanically coupled to the rotating restrictor and the turbine.

Next, at step 511, the acoustic telemetry signal is generated with the rotating restrictor and the non-rotating restrictor based on the adjusted rotational velocity of the rotating restrictor. In some aspects, the acoustic telemetry signal includes the different acoustic signatures that correspond to the encoded digital signal. In generating the acoustic telemetry signal, the process 500 may include a step for producing adjustments to fluidic pulses flowing through the rotating restrictor aligned relative to the non-rotating restrictor to encode the different acoustic signatures in the acoustic telemetry signal.

Subsequently, at step 513, the acoustic telemetry signal is processed with the computing subsystem. In processing the acoustic telemetry signal, the process 500 may include a step for determining whether a change in frequency occurs in the acoustic telemetry signal within a predetermined duration of time. In some aspects, the change in frequency is determined to have occurred when the change in frequency exceeds a first predetermined threshold during the predetermined duration of time. In other aspects, the change in frequency is determined to not have occurred when the change in frequency does not exceed a second predetermined threshold during the predetermined duration of time. In processing the acoustic telemetry signal, the process 500 may also include a step for determining that the acoustic telemetry signal indicates a first logical value when the change in frequency exceeds the first predetermined threshold during a first predetermined duration of time. Next, the process 500 may include a step for determining that the acoustic telemetry signal indicates a second logical value different from the first logical value when the change in frequency does not exceed the second predetermined threshold during a second predetermined duration of time different from the first predetermined duration of time. In some aspects, the processed acoustic telemetry signal includes a sequence of logical values including the first and second logical values, in which a first portion of the processed acoustic telemetry signal indicates a location of a fluid breakthrough occurrence along the wellbore, and a second portion of the processed acoustic telemetry signal indicates a type of fluid associated with the fluid breakthrough occurrence. Next, at step 515, downhole completion operations are facilitated in the wellbore based on the processed acoustic telemetry signal.

Figure 6:
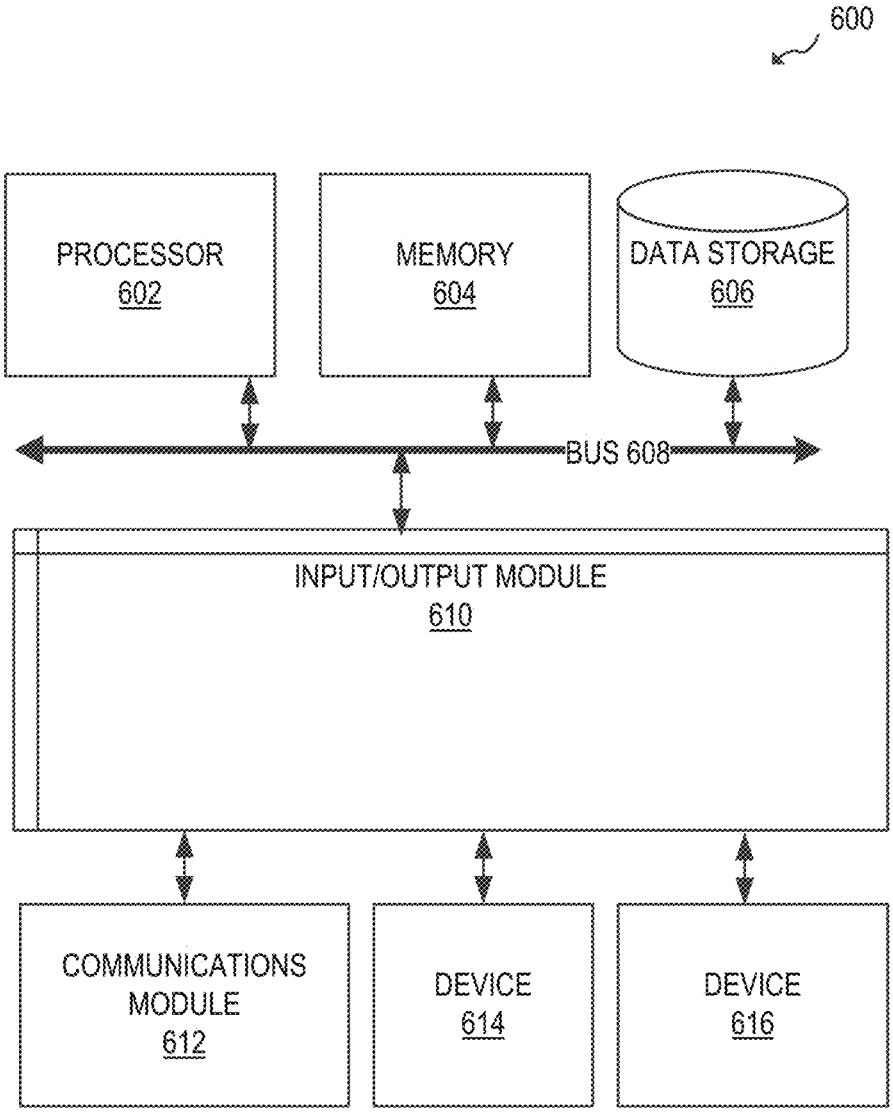
FIG. 6 is a block diagram illustrating an exemplary computer system with which the computing subsystem of FIG. 1 can be implemented.

FIG. 6 is a block diagram illustrating an exemplary computer system 600 with which the computing subsystem 148 of FIG. 1 can be implemented. In certain aspects, the computer system 600 may be implemented using hardware or a combination of software and hardware, either in a dedicated server, integrated into another entity, or distributed across multiple entities.

Computer system 600 (e.g., computing subsystem 148) includes a bus 608 or other communication mechanism for communicating information, and a processor 602 coupled with bus 608 for processing information. By way of example, the computer system 600 may be implemented with one or more processors 602. Processor 602 may be a general-purpose microprocessor, a microcontroller, a Digital Signal Processor (DSP), an Application Specific Integrated Circuit (ASIC), a Field Programmable Gate Array (FPGA), a Programmable Logic Device (PLD), a controller, a state machine, gated logic, discrete hardware components, or any other suitable entity that can perform calculations or other manipulations of information.

Computer system 600 can include, in addition to hardware, code that creates an execution environment for the computer program in question, e.g., code that constitutes processor firmware, a protocol stack, a database management system, an operating system, or a combination of one or more of them stored in an included memory 604, such as a Random Access Memory (RAM), a flash memory, a Read Only Memory (ROM), a Programmable Read-Only Memory (PROM), an Erasable PROM (EPROM), registers, a hard disk, a removable disk, a CD-ROM, a DVD, or any other suitable storage device, coupled to bus 608 for storing information and instructions to be executed by processor 602. The processor 602 and the memory 604 can be supplemented by, or incorporated in, special purpose logic circuitry.

The instructions may be stored in the memory 604 and implemented in one or more computer program products, i.e., one or more modules of computer program instructions encoded on a computer readable medium for execution by, or to control the operation of, the computer system 600, and according to any method well known to those of skill in the art, including, but not limited to, computer languages such as data-oriented languages (e.g., SQL, dBase), system languages (e.g., C, Objective-C, C++, Assembly), architectural languages (e.g., Java, .NET), and application languages (e.g., PHP, Ruby, Perl, Python). Instructions may also be implemented in computer languages such as array languages, aspect-oriented languages, assembly languages, authoring languages, command line interface languages, compiled languages, concurrent languages, curly-bracket languages, dataflow languages, data-structured languages, declarative languages, esoteric languages, extension languages, fourth-generation languages, functional languages, interactive mode languages, interpreted languages, iterative languages, list-based languages, little languages, logic-based languages, machine languages, macro languages, metaprogramming languages, multiparadigm languages, numerical analysis, non-English-based languages, object-oriented class-based languages, object-oriented prototype-based languages, off-side rule languages, procedural languages, reflective languages, rule-based languages, scripting languages, stack-based languages, synchronous languages, syntax handling languages, visual languages, wirth languages, and xml-based languages. Memory 604 may also be used for storing temporary variable or other intermediate information during execution of instructions to be executed by processor 602.

A computer program as discussed herein does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, subprograms, or portions of code). A computer program can be deployed to be executed on one computer or on multiple computers that are located at one site or distributed across multiple sites and interconnected by a communication network. The processes and logic flows described in this specification can be performed by one or more programmable processors executing one or more computer programs to perform functions by operating on input data and generating output.

Computer system 600 further includes a data storage device 606 such as a magnetic disk or optical disk, coupled to bus 608 for storing information and instructions. Computer system 600 may be coupled via input/output module 610 to various devices. The input/output module 610 can be any input/output module. Exemplary input/output modules 610 include data ports such as USB ports. The input/output module 610 is configured to connect to a communications module 612. Exemplary communications modules 612 include networking interface cards, such as Ethernet cards and modems. In certain aspects, the input/output module 610 is configured to connect to a plurality of devices, such as an input device 614 and/or an output device 616. Exemplary input devices 614 include a keyboard and a pointing device, e.g., a mouse or a trackball, by which a user can provide input to the computer system 600. Other kinds of input devices 614 can be used to provide for interaction with a user as well, such as a tactile input device, visual input device, audio input device, or brain-computer interface device. For example, feedback provided to the user can be any form of sensory feedback, e.g., visual feedback, auditory feedback, or tactile feedback, and input from the user can be received in any form, including acoustic, speech, tactile, or brain wave input. Exemplary output devices 616 include display devices such as a LCD (liquid crystal display) monitor, for displaying information to the user.

According to one aspect of the present disclosure, the computing subsystem 110 can be implemented using a computer system 600 in response to processor 602 executing one or more sequences of one or more instructions contained in memory 604. Such instructions may be read into memory 604 from another machine-readable medium, such as data storage device 606. Execution of the sequences of instructions contained in the main memory 604 causes processor 602 to perform the process steps described herein. One or more processors in a multi-processing arrangement may also be employed to execute the sequences of instructions contained in the memory 604. In alternative aspects, hard-wired circuitry may be used in place of or in combination with software instructions to implement various aspects of the present disclosure. Thus, aspects of the present disclosure are not limited to any specific combination of hardware circuitry and software.

Various aspects of the subject matter described in this specification can be implemented in a computing system that includes a back end component, e.g., such as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. The communication network can include, for example, any one or more of a LAN, a WAN, the Internet, and the like. Further, the communication network can include, but is not limited to, for example, any one or more of the following network topologies, including a bus network, a star network, a ring network, a mesh network, a star-bus network, tree or hierarchical network, or the like. The communications modules can be, for example, modems or Ethernet cards.

Computer system 600 can include clients and servers. A client and server are generally remote from each other and typically interact through a communication network. The relationship of client and server arises by virtue of computer programs running on the respective computers and having a client-server relationship to each other. Computer system 600 can be, for example, and without limitation, a desktop computer, laptop computer, or tablet computer. Computer system 600 can also be embedded in another device, for example, and without limitation, a mobile telephone such as a smartphone.

The term "machine-readable storage medium" or "computer readable medium" as used herein refers to any medium or media that participates in providing instructions to processor 602 for execution. Such a medium may take many forms, including, but not limited to, non-volatile media, volatile media, and transmission media. Non-volatile media include, for example, optical or magnetic disks, such as data storage device 606. Volatile media include dynamic memory, such as memory 604. Transmission media include coaxial cables, copper wire, and fiber optics, including the wires that comprise bus 608. Common forms of machine-readable media include, for example, floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH EPROM, any other memory chip or cartridge, or any other medium from which a computer can read. The machine-readable storage medium can be a machine-readable storage device, a machine-readable storage substrate, a memory device, a composition of matter effecting a machine-readable propagated signal, or a combination of one or more of them.

Various examples of aspects of the disclosure are described below. These are provided as examples, and do not limit the subject technology.

A system for fluidic siren based telemetry is provided that includes a non-rotating restrictor and a rotating restrictor positioned relative to the non-rotating restrictor and configured to control a flow passage to the non-rotating restrictor. The system also includes a turbine mechanically coupled to the rotating restrictor and configured to rotate in response to fluid flow along a flow path and a generator coupled to the turbine. The system also includes a controller device coupled to the generator and configured to provide one or more signals to the generator to adjust a rotational velocity of the rotating restrictor and causing the rotating restrictor to create different acoustic signatures through the flow passage for wireless communication of a telemetry signal based on the adjusted rotational velocity of the rotating restrictor.

In some aspects, each of the different acoustic signatures represents at least a portion of a telemetry signal associated with a fluid breakthrough event in a wellbore.

In some aspects, the system also includes a downhole sensor electrically coupled to the controller device and configured to obtain one or more downhole measurements along a wellbore, in which the one or more downhole measurements indicate a property of fluid flow.

In some aspects, the controller device obtains the one or more downhole measurements from the downhole sensor and generates the one or more signals when the one or more downhole measurements indicate the property of fluid flow.

In some aspects, the generator is operable to generate power in response to rotation of the turbine and to drive an electrical load with the generated power.

In some aspects, the generated power is stored and consumed by at least the generator to provide resistance from the generator to the turbine when telemetry information is ready to be communicated through the flow passage, in which the provided resistance causes the rotational velocity of the rotating restrictor to decrease.

In some aspects, the generator does not provide the resistance to the rotating restrictor during the normal fluid flow.

In some aspects, the system includes a shaft mechanically coupled to the turbine and the rotating restrictor, in which the turbine is arranged along a longitudinal length of the shaft.

In some aspects, the rotating restrictor rotates relative to the non-rotating restrictor to facilitate an opening and closing of the flow passage through the rotating restrictor and the non-rotating restrictor that creates each of the different acoustic signatures.

In some aspects, each of the non-rotating restrictor and the rotating restrictor have a corresponding number of openings through which the flow passage traverses, in which a first acoustic signature of the different acoustic signatures is a multiple of a first frequency when the generator provides resistance onto the rotating restrictor and a second acoustic signature of the different acoustic signatures is a multiple of a second frequency greater than the first frequency when the generator does not provide the resistance onto the rotating restrictor, where the multiple corresponds to the number of openings.

In some aspects, the one or more signals comprise a sequence of binary values mapped from one or more downhole measurements, in which a first portion of the sequence of binary values indicates a location of a fluid along a wellbore, and a second portion of the sequence of binary values indicates a type of the fluid.

In some aspects, the sequence of binary values comprises a first logical value and a second logical value, in which the first logical value causes the generator to apply a resistance onto the rotating restrictor that decreases the rotational velocity of the rotating restrictor, and the second logical value causes the generator to remove application of the resistance onto the rotating restrictor that increases the rotational velocity of the rotating restrictor when the resistance was previously applied to the rotating restrictor, where each of the first logical value and the second logical value corresponds to one of the different acoustic signatures produced by the rotating restrictor with the non-rotating restrictor.

In some aspects, the system includes a completion string coupled to a distal end of a tubing string positioned within a wellbore and configured to perform completion operations using fluid obtained from a surrounding subterranean formation, in which the non-rotating restrictor and the rotating restrictor are positioned within an inner diameter of the completion string, and the generator and the controller device are arranged within the completion string and are housed in a chamber isolated from fluid flow through the completion string.

In some aspects, the system includes a screen assembly positioned on the completion string and located upstream between the rotating restrictor and a subterranean formation to filter contaminants in fluid obtained from the subterranean formation.

A method for fluidic siren based telemetry is provided. The method includes deploying a completion string into a wellbore penetrating one or more subterranean formations, in which the completion string is coupled to a computing subsystem positioned on a surface. The method also includes actuating a downhole fluidic siren arranged in the completion string in response to fluid flow through the completion string, in which the downhole fluidic siren is configured to generate an acoustic telemetry signal for transmission to the surface through fluid in the wellbore. In some aspects, the downhole fluidic siren includes a turbine interposed between a rotating restrictor and a generator that provides resistance to the rotating restrictor for creating different acoustic signatures through a flow passage between the rotating restrictor and a non-rotating restrictor. The method also includes obtaining a downhole measurement from a sensor electrically coupled to the generator, and encoding the downhole measurement into an encoded digital signal to control a load on the generator. The method also includes adjusting a rotational velocity of the rotating restrictor with the generator in response to a binary value from the encoded digital signal. The method also includes generating the acoustic telemetry signal with the rotating restrictor and the non-rotating restrictor based on the adjusted rotational velocity of the rotating restrictor, in which the acoustic telemetry signal includes the different acoustic signatures that correspond to the encoded digital signal. The method also includes processing the acoustic telemetry signal with the computing subsystem, and facilitating downhole completion operations in the wellbore based on the processed acoustic telemetry signal.

In encoding the downhole measurement, the method includes reading a value from the downhole measurement obtained by the sensor with a controller device electrically coupled to the generator, converting the value from an analog domain to a digital domain to produce a digital command value using an analog-to-digital converter along a signal path from the sensor, and mapping the digital command value into a binary pattern using an encoder arranged along the signal path from the analog-to-digital converter to generate a binary-patterned electrical signal in the encoded digital signal.

In adjusting the rotational velocity of the rotating restrictor, the method includes proportioning the binary pattern to different amounts of resistance applied by the generator such that each amount of resistance applied corresponds to a different rotational velocity produced by the rotating restrictor.

In adjusting the rotational velocity of the rotating restrictor, the method includes adjusting the load on the generator to produce the resistance against a rotation of the rotating restrictor, and applying the resistance to the rotating restrictor through a shaft mechanically coupled to the rotating restrictor and the turbine.

In generating the acoustic telemetry signal, the method includes producing adjustments to fluidic pulses flowing through the rotating restrictor aligned relative to the non-rotating restrictor to encode the different acoustic signatures in the acoustic telemetry signal.

In processing the acoustic telemetry signal, the method includes determining whether a change in frequency occurs in the acoustic telemetry signal within a predetermined duration of time, in which the change in frequency is determined to have occurred when the change in frequency exceeds a first predetermined threshold during the predetermined duration of time, and the change in frequency is determined to not have occurred when the change in frequency does not exceed a second predetermined threshold during the predetermined duration of time. The method also includes determining that the acoustic telemetry signal indicates a first logical value when the change in frequency exceeds the first predetermined threshold during a first predetermined duration of time. The method also includes determining that the acoustic telemetry signal indicates a second logical value different from the first logical value when the change in frequency does not exceed the second predetermined threshold during a second predetermined duration of time different from the first predetermined duration of time, in which the processed acoustic telemetry signal comprises a sequence of logical values including the first and second logical values, where a first portion of the processed acoustic telemetry signal indicates a location of a fluid along the wellbore and a second portion of the processed acoustic telemetry signal indicates a type of the fluid.

In one or more aspects, examples of clauses are described below.

A method comprising one or more methods, operations or portions thereof described herein.

An apparatus comprising one or more memories and one or more processors (e.g., 610), the one or more processors configured to cause performing one or more methods, operations or portions thereof described herein.

An apparatus comprising one or more memories (e.g., 620, one or more internal, external or remote memories, or one or more registers) and one or more processors (e.g., 612) coupled to the one or more memories, the one or more processors configured to cause the apparatus to perform one or more methods, operations or portions thereof described herein.

An apparatus comprising means (e.g., 610) adapted for performing one or more methods, operations or portions thereof described herein.

A processor (e.g., 612) comprising modules for carrying out one or more methods, operations or portions thereof described herein.

A hardware apparatus comprising circuits (e.g., 610) configured to perform one or more methods, operations or portions thereof described herein.

An apparatus comprising means (e.g., 610) adapted for performing one or more methods, operations or portions thereof described herein.

An apparatus comprising components (e.g., 610) operable to carry out one or more methods, operations or portions thereof described herein.

A computer-readable storage medium (e.g., 620, one or more internal, external or remote memories, or one or more registers) comprising instructions stored therein, the instructions comprising code for performing one or more methods or operations described herein.

A computer-readable storage medium (e.g., 620, one or more internal, external or remote memories, or one or more registers) storing instructions that, when executed by one or more processors, cause one or more processors to perform one or more methods, operations or portions thereof described herein.

In one aspect, a method may be an operation, an instruction, or a function and vice versa. In one aspect, a clause or a claim may be amended to include some or all of the words (e.g., instructions, operations, functions, or components) recited in other one or more clauses, one or more words, one or more sentences, one or more phrases, one or more paragraphs, and/or one or more claims.

To illustrate the interchangeability of hardware and software, items such as the various illustrative blocks, modules, components, methods, operations, instructions, and algorithms have been described generally in terms of their functionality. Whether such functionality is implemented as hardware, software or a combination of hardware and software depends upon the particular application and design constraints imposed on the overall system. Skilled artisans may implement the described functionality in varying ways for each particular application.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the subject technology. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

Therefore, the subject technology is well adapted to attain the ends and advantages mentioned as well as those that are inherent therein. The particular embodiments disclosed above are illustrative only, as the subject technology may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the subject technology. The subject technology illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A system for fluidic siren based telemetry, the system comprising:

a non-rotating restrictor;

a rotating restrictor positioned relative to the non-rotating restrictor and configured to control a flow passage to the non-rotating restrictor;

a turbine mechanically coupled to the rotating restrictor and configured to rotate in response to fluid flow along a flow path;

a generator coupled to the turbine; and a controller device coupled to the generator and configured to provide one or more signals to the generator to adjust a rotational velocity of the rotating restrictor and causing the rotating restrictor to create different acoustic signatures through the flow passage for wireless communication of a telemetry signal based on the adjusted rotational velocity of the rotating restrictor wherein the one or more signals comprise a sequence of binary values mapped from one or more downhole measurements, wherein the sequence of binary values comprises a first logical value and a second logical value, wherein the first logical value causes the generator to apply a resistance onto the rotating restrictor that decreases the rotational velocity of the rotating restrictor, wherein the second logical value causes the generator to remove application of the resistance onto the rotating restrictor that increases the rotational velocity of the rotating restrictor when the resistance was previously applied to the rotating restrictor, and wherein each of the first logical value and the second logical value corresponds to one of the different acoustic signatures produced by the rotating restrictor with the non-rotating restrictor.

2. The system of claim 1, wherein each of the different acoustic signatures represents at least a portion of a telemetry signal associated with a fluid breakthrough event in a wellbore.

3. The system of claim 1, further comprising:

a downhole sensor electrically coupled to the controller device and configured to obtain one or more downhole measurements along a wellbore, the one or more downhole measurements indicating a property of fluid flow.

4. The system of claim 3, wherein the controller device obtains the one or more downhole measurements from the downhole sensor and generates the one or more signals when the one or more downhole measurements indicate the property of fluid flow.

5. The system of claim 1, wherein the generator is operable to generate power in response to rotation of the turbine and to drive an electrical load with the generated power.

6. The system of claim 5, wherein the generated power is stored and consumed by at least the generator to provide resistance from the generator to the turbine when telemetry information is ready to be communicated through the flow passage, wherein the provided resistance causes the rotational velocity of the rotating restrictor to decrease.

7. The system of claim 6, wherein the generator does not provide the resistance to the rotating restrictor during the normal fluid flow.

8. The system of claim 1, further comprising:

a shaft mechanically coupled to the turbine and the rotating restrictor, the turbine being arranged along a longitudinal length of the shaft.

9. The system of claim 1, wherein the rotating restrictor rotates relative to the non-rotating restrictor to facilitate an opening and closing of the flow passage through the rotating restrictor and the non-rotating restrictor that creates each of the different acoustic signatures.

10. The system of claim 1, wherein each of the non-rotating restrictor and the rotating restrictor have a corresponding number of openings through which the flow passage traverses, wherein a first acoustic signature of the different acoustic signatures is a multiple of a first frequency when the generator provides resistance onto the rotating restrictor, wherein a second acoustic signature of the different acoustic signatures is a multiple of a second frequency greater than the first frequency when the generator does not provide the resistance onto the rotating restrictor, and wherein the multiple corresponds to the number of openings.

11. The system of claim 1, wherein a second portion of the sequence of binary values indicates a type of the fluid.

12. The system of claim 1, further comprising:

a completion string coupled to a distal end of a tubing string positioned within a wellbore and configured to perform completion operations using fluid obtained from a surrounding subterranean formation, wherein the non-rotating restrictor and the rotating restrictor are positioned within an inner diameter of the completion string, and wherein the generator and the controller device are arranged within the completion string and are housed in a chamber isolated from fluid flow through the completion string.

13. The system of claim 12, further comprising:

a screen assembly positioned on the completion string and located upstream between the rotating restrictor and a subterranean formation to filter contaminants in fluid obtained from the subterranean formation.

14. A method for fluidic siren based telemetry, comprising:

deploying a completion string into a wellbore penetrating one or more subterranean formations, the completion string coupled to a computing subsystem positioned on a surface;

actuating a downhole fluidic siren arranged in the completion string in response to fluid flow through the completion string, the downhole fluidic siren being configured to generate an acoustic telemetry signal for transmission to the surface through fluid in the wellbore, the downhole fluidic siren comprising a turbine interposed between a rotating restrictor and a generator that provides resistance to the rotating restrictor for creating different acoustic signatures through a flow passage between the rotating restrictor and a non-rotating restrictor;

obtaining a downhole measurement from a sensor electrically coupled to the generator;

encoding the downhole measurement into an encoded digital signal to control a load on the generator;

adjusting a rotational velocity of the rotating restrictor with the generator in response to a binary value from the encoded digital signal;

generating the acoustic telemetry signal with the rotating restrictor and the non-rotating restrictor based on the adjusted rotational velocity of the rotating restrictor, the acoustic telemetry signal comprising the different acoustic signatures that correspond to the encoded digital signal;

processing the acoustic telemetry signal with the computing subsystem; and facilitating downhole completion operations in the wellbore based on the processed acoustic telemetry signal.

15. The method of claim 14, wherein encoding the downhole measurement comprises:

reading a value from the downhole measurement obtained by the sensor with a controller device electrically coupled to the generator;

converting the value from an analog domain to a digital domain to produce a digital command value using an analog-to-digital converter along a signal path from the sensor; and mapping the digital command value into a binary pattern using an encoder arranged along the signal path from the analog-to-digital converter to generate a binary-patterned electrical signal in the encoded digital signal.

16. The method of claim 15, wherein adjusting the rotational velocity of the rotating restrictor comprises:

proportioning the binary pattern to different amounts of resistance applied by the generator such that each amount of resistance applied corresponds to a different rotational velocity produced by the rotating restrictor.

17. The method of claim 14, wherein adjusting the rotational velocity of the rotating restrictor comprises:

adjusting the load on the generator to produce the resistance against a rotation of the rotating restrictor; and applying the resistance to the rotating restrictor through a shaft mechanically coupled to the rotating restrictor and the turbine.

18. The method of claim 17, wherein generating the acoustic telemetry signal comprises:

producing adjustments to fluidic pulses flowing through the rotating restrictor aligned relative to the non-rotating restrictor to encode the different acoustic signatures in the acoustic telemetry signal.

19. The method of claim 14, wherein processing the acoustic telemetry signal comprises:

determining whether a change in frequency occurs in the acoustic telemetry signal within a predetermined duration of time, wherein the change in frequency is determined to have occurred when the change in frequency exceeds a first predetermined threshold during the predetermined duration of time, wherein the change in frequency is determined to not have occurred when the change in frequency does not exceed a second predetermined threshold during the predetermined duration of time;

determining that the acoustic telemetry signal indicates a first logical value when the change in frequency exceeds the first predetermined threshold during a first predetermined duration of time; and determining that the acoustic telemetry signal indicates a second logical value different from the first logical value when the change in frequency does not exceed the second predetermined threshold during a second predetermined duration of time different from the first predetermined duration of time, wherein the processed acoustic telemetry signal comprises a sequence of logical values including the first and second logical values, wherein a first portion of the processed acoustic telemetry signal indicates a location of a fluid along the wellbore, and wherein a second portion of the processed acoustic telemetry signal indicates a type of the fluid.

* * * * *